United States Patent [19]

Steiniger et al.

[11] Patent Number: 4,729,387

[45] Date of Patent: Mar. 8, 1988

[54] METHOD AND APPARATUS FOR MAKING CIGARETTES WITH SOFT CORES

[75] Inventors: Wolfgang Steiniger, Börnsen; Manfred Goldbach, Hamburg, both of Fed. Rep. of Germany

[73] Assignee: Körber AG, Hamburg, Fed. Rep. of Germany

[21] Appl. No.: 874,039

[22] Filed: Jun. 13, 1986

[30] Foreign Application Priority Data

Jun. 20, 1985 [DE] Fed. Rep. of Germany ..... 3521972

[51] Int. Cl.[4] ..... A24C 5/18

[52] U.S. Cl. ..... 131/84.1; 131/84.3; 131/84.4; 131/360; 131/361

[58] Field of Search ..... 131/84.1, 84.3, 84.4, 131/360, 361

[56] References Cited

U.S. PATENT DOCUMENTS

| | | | |
|---|---|---|---|
| 3,260,265 | 7/1966 | Oster | 131/360 |
| 4,580,579 | 4/1986 | Wahle et al. | 131/84.4 |
| 4,593,704 | 6/1986 | Wahle et al. | 131/84.4 |
| 4,605,013 | 8/1986 | Goldbach | 131/84.1 |
| 4,616,662 | 10/1986 | Hartmann et al. | 131/84.3 |
| 4,632,130 | 12/1986 | Heitmann et al. | 131/84.4 |

FOREIGN PATENT DOCUMENTS

| | | | |
|---|---|---|---|
| 1338546 | 8/1963 | France | 131/84.3 |
| 2150408 | 7/1985 | United Kingdom . | |

*Primary Examiner*—V. Millin

*Attorney, Agent, or Firm*—Peter K. Kontler

[57] ABSTRACT

Cigarettes with soft cores are produced by forming a continuous stream having a U-shaped cross-sectional outline and advancing the stream along a stationary mandrel and past a shower of tobacco which conceals the mandrel and forms with the stream a ring-shaped filler which is stripped off the mandrel, draped into a web of cigarette paper and subdivided into cigarettes of desired length.

45 Claims, 12 Drawing Figures

SB
73
64
64
94
96
95
66
61
77
IX
67
VIII
72
78a
99
97
99
VIII
62
VII
74
VII
42
59
41
58
IX
68
98
69
98
76
57
56
76
57
76
56
58
A 57
59
58
VI
VI 67
64
93c
93b
93a 93b
97
101
43
V
39
V
71
67
64
93c
93a 93b
93b
70
97
70
78
106
66
64
67
107
53
97
5
103
104
103
102
54

71
44
71

78

METHOD AND APPARATUS FOR MAKING CIGARETTES WITH SOFT CORES

CROSS-REFERENCE TO RELATED CASES

Methods and apparatus which are similar to the method and apparatus of the present invention are disclosed in commonly owned copending patent applications Ser. Nos. (1) 575,169 filed Jan. 30, 1984 by Manfred Goldbach for "Method and apparatus for forming discrete batches of tobacco particles", now U.S. Pat. No. 4,605,013 granted 8/12/86; (2) 622,680 filed June 30, 1984 by Joachim Reuland et al. for "Method and apparatus for producing a rod-shaped filter from several types of smokable material", now U.S. Pat. No. 4,616,662 granted 10/14/1986; (3) 660,431 filed Oct. 11, 1984 by Uwe Heitmann et al. for "Method and apparatus for making rod-shaped smokers products with soft cores; (4) 660,430 filed Oct. 11, 1984 by Uwe Heitmann et al. for "Method and apparatus for making a rod-like filler of smokable material"; (5) 836,527 filed Mar. 5, 1986 by Manfred Goldbach et al. for "Apparatus for forming batches of tobacco and the like"; (6) 836,387 filed Mar. 5, 1986 by Manfred Goldbach et al. for "Method and apparatus for accumulating particles of tobacco into batches and for forming a composite stream containing several types of tobacco; and 836,389 filed Mar. 5, 1986 by Siegfried Marquardt et al. for "Method and apparatus for making rod-like fillers from several types of fibrous material".

BACKGROUND OF THE INVENTION

The present invention relates to a method of and to an apparatus for making so-called soft-core cigarettes and analogous rod-shaped articles of the tobacco processing industry wherein the central portion of the fibrous filler is softer than the surrounding portion. The invention also relates to rod-shaped articles which are obtained in accordance with the improved method and by using the improved apparatus.

German Pat. No. 11 64 907 discloses the making of cigarettes which are provided with axially extending holes as a result of the utilization of a stationary mandrel which is embedded in the tobacco stream and continuously discharges a stabilizer in order to avoid clogging or filling of the hole which is formed by the mandrel.

British Pat No. 1,086,443 discloses a cigarette which has a centrally located hole bounded by a cylindrical surface, or which has a centrally located core of lesser density.

Published British patent application No. 2 150 408 discloses a method of forming a cigarette filler with a less densified inner region. The method includes forming a tobacco stream having a U-shaped cross-sectional outline and closing the stream by bending the legs of the U toward each other.

Published British patent application No. 2 150 008 discloses a method which is also used to form a tobacco filler having a softer central portion. The filler is obtained by forming two tobacco streams each of which has a U-shaped cross-sectional outline and by superimposing one of the streams upon the other. The thus superimposed streams are then densified while surrounding a stationary mandrel.

A drawback of heretofore known proposals is that the cigarettes must be produced in specially designed machines deviating completely from those which are used for the making of conventional cigarettes.

OBJECTS AND SUMMARY OF THE INVENTION

An object of the invention is to provide a novel and improved method of forming a succession of soft-core cigarettes in a continuous operation and at a rate which warrants the utilization of the method for mass-production of soft-core cigarettes.

Another object of the invention is to provide a method which can be practiced with relatively simple apparatus and ensures a highly predictable distribution of densities in each of a short or long series of rod-shaped articles.

A further object of the invention is to provide a method which can be utilized to simultaneously influence the aroma, the moisture content and/or other parameters of the rod-shaped articles.

An additional object of the invention is to provide a novel and improved apparatus for the practice of the above outlined method.

Still another object of the invention is to provide the apparatus with novel and improved means for forming a continuous rod-like filler whose central portion is softer than the surrounding outer portion.

A further object of the invention is to provide rod-shaped articles which exhibit softer cores and denser outer portions.

One feature of the invention resides in the provision of a method of producing rod-shaped articles of the tobacco processing industry from fibrous material, particularly tobacco, with assistance from a mandrel of non-smokable material. The method comprises the steps of forming a continuous fibrous stream having a substantially U-shaped or trough-shaped cross-sectional outline with a longitudinally extending cavity and two legs flanking the cavity, advancing the stream along the mandrel so that the mandrel at least partially fills the cavity, feeding fibrous material against the moving stream and the exposed part of the mandrel so as to confine the cavity and the mandrel and to thereby transform the stream into a filler having a ring-shaped cross-sectional outline, separating the filler from the mandrel, draping the separated filler into a web of wrapping material (e.g., into a strip of cigarette paper), and subidividng the draped filler into rod-shaped articles of predetermined length.

The forming step can comprise admitting fibrous material into the groove of a first driven endless conveyor so that the cavity of the resulting stream is confined (by facing toward the adjacent portion of the conveyor), and thereupon transferring the stream onto a second driven endless conveyor on which the cavity is exposed so that it can receive the mandrel. The first conveyor can include a wheel having a circumferentially extending groove with a central portion of lesser depth and two marginal portions of greater depth which flank the central portion. The method preferably further comprises the step of holdlng the fibrous material on at least one of the conveyors by suction. Still further, the method preferably comprises the step of equalizing or trimming the stream on the first conveyor and/or of equalising or trimming the filler prior to the draping step, preferably prior to the separating step.

The method can also comprise the step of vibrating the mandrel, and such vibrating step preferably includes imparting to the mandrel an oscillatory movement at a frequency in the ultrasonic range because this reduces the likelihood of establishment of pronounced friction between the external surface of the mandrel on the one hand and the adjacent surface of the stream and/or filler on the other hand.

The vibrating step can be carried out in addition to or in lieu of admitting a gaseous fluid medium (e.g., air) between the mandrel and the surrounding fibrous material so as to reduce friction between the mandrel on the one hand and the stream and the filler on the other hand. The fluid medium can serve the sole purpose of reducing friction between the external surface of the mandrel and the adjacent surface of the stream and/or filler. The fluid medium can be discharged into the fibrous material by employing a nozzle-like mandrel with one or more internal channels and orifices which discharge the fluid medium into the stream and/or into the filler. The fluid medium can constitute a conditioning medium which contains one or more aromatic substances to influence the aroma, taste and/or other characteristics of the material of the filler. In addition to or instead of carrying one or more aromatic substances, the fluid medium can be used to draw moisture from, to add moisture to and/or to change the temperature of the fibrous material.

The stream forming step can comprise establishing and maintaining a supply of fibrous material in a magazine, distributor, hopper or a like source, drawing from the supply a preferably continuous flow of fibrous material and pneumatically conveying the flow, and converting at least a portion of the pneumatically conveyed flow into the stream. The drawing step can include showering fibrous material in a first direction into a stream building zone and conveying the showered fibrous material in the stream building zone in a second direction transversely of the first direction. The showering step can comprise propelling fibrous material against one side of a driven endless foraminous belt conveyor and attracting the fibrous material to the belt conveyor by suction.

The method can further comprise the step of equalizing the flow.

The converting step can include utilizing a portion of the pneumatically conveyed flow for the making of the stream, and the method then further comprises the step of returning the remaining portion of the flow to the supply. The step of pneumatically conveying includes transporting the fibrous material in a gaseous carrier medium, and the returning step preferably includes separating the gaseous carrier medium from the remaining portion of the flow, e.g., in a cyclone separator.

Another feature of the invention resides in the provision of an apparatus for producing rod-shaped articles of the tobacco processing industry from fibrous material, particularly from natural, reconstituted and/or artificial tobacco and/or filter material. The apparatus comprises an elongated mandrel, means for forming a continuous fibrous stream having a substantially U-shaped or trough-shaped cross-sectional outline with a longitudinally extending cavity and two legs flanking the cavity, means for advancing the stream along the mandrel so that the mandrel at least partially fills the cavity, means for feeding (particularly showering) fibrous material against the moving stream and against the stationary mandrel so as to confine the cavity and the mandrel and thereby transform the stream into a filler having a ring-shaped cross-sectional outline, and means for draping the filler into a web of wrapping material, e.g., into a strip of cigarette paper. This may result in partial filling of the cavity with fibrous material but the density of the central portion or core of the filler is still less pronounced than the density of the surrounding tubular section including the prefabricated stream and the fibrous material which has been showered against the stream and the mandrel.

The apparatus further comprises mean for separating the filler from the mandrel and a cutoff or other suitable means for subdividing the draped filler into rod-shaped sections (e.g., plain cigarettes, cigarillos or cigars) of unit length or multiple unit length. The advancing means can comprise or constitute the separating means.

The forming means can comprise a driven endless conveyor, for example, a rotary wheel having a circumferential stream-forming groove including a central portion having a first depth and two marginal portions which flank the central portion and have a greater second depth. Fibrous material which is admitted into such groove is converted into a stream having a U-shaped cross-sectional outline and including a cavity which faces toward the axis of rotation of the wheel, i.e., the cavity is concealed as long as the stream remains in the groove. The advancing means preferably comprises a second endless conveyor which serves to receive the stream from the groove of the wheel so that the cavity of the transferred stream is exposed and can receive the mandrel. The latter is adjacent to the path which is defined by the second endless conveyor. Means can be provided for attracting the stream to the wheel and/or to the second conveyor by suction. To this end, the second conveyor and/or the wheel includes a foraminous portion which is adjacent to the respective portion of the path of movement of the stream.

The apparatus can further comprise means for equalizing the stream on the first or second endless conveyor and/or for equalizing the filler prior to draping.

Means can be provided to vibrate the mandrel, and such vibrating means preferably comprises means for oscillating the mandrel at a frequency in the ultrasonic range. This reduces friction between the external surface of the mandrel and the adjacent internal surface of the stream and/or filler.

The mandrel can be provided with one or more orifices and can be connected with a source of compressed gaseous fluid which admits such fluid to the orifice or orifices for penetration into fibrous material adjacent the external surface of the mandrel. The gaseous fluid can contain or can consist of air which serves to reduce friction between the mandrel and fibrous material. The source can contain a fluid which is used to condition the fibrous material, e.g., to change the moisture content and/or to change the aroma and/or the temperature of the fibrous material.

The apparatus preferably further comprises a magazine or another suitable source of fibrous material, a first driven endless conveyor and means for delivering fibrous material from the source to the first conveyor to build thereon a narrow flow of fibrous material. The forming means then comprise a second driven endless conveyor which serves to transform the flow into the stream. Such forming means preferably further comprises a pneumatic conveyor which serves to transport the flow from the first endless conveyor to the second endless conveyor. The delivering means can comprise means for showering fibrous material onto the first conveyor. The first conveyor is or can be foraminous so that it can cooperate with a suction chamber or with other suitable means for attracting fibrous material to the first conveyor by suction. Means can be provided to equalize the flow ahead of the second conveyor. The equalizing means can include means for removing some fibrous material from the flow and the apparatus can further comprise means for adjusting the equalizing means so as to regulate the quantity of removed fibrous material. The aforementioned pneumatic conveyor can be designed to transfer successive increments of the flow from the first to the second endless conveyor by suction in a current of air or another gaseous carrier medium. The fibrous material is preferably supplied in such quantities that the second endless conveyor accepts only a portion of the flow and the remaining portion of the flow is returned to the source, preferably in a conduit which contains a cyclone separator or other suitable means for separating the non-accepted portion of the flow from the gaseous carrier medium before the non-accepted portion is returned to the source.

The novel rod-shaped smokers' product comprises a filler of fibrous material and a tubular wrapper surrounding the filler. The filler includes a relatively soft core (i.e., a core of low or zero density) and a relatively hard tubular section surrounding the core. The filler is produced in accordance with the above outlined method and in the above outlined apparatus, i.e., its tubular section includes a prefabricated first U-shaped portion (the aforediscussed stream) and a second U-shaped portion which is substantially mirror symmetrical to the first U-shaped portion and consists of a converted shower of fibrous material, i.e., fibrous material which has been showered against the legs of the aforediscussed stream as well as against the exposed portion of the mandrel in the cavity of such stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*a* is an enlarged partly elevational and partly vertical sectional view of the detail Z1 in FIG. 2;

FIG. 4*a* is an enlarged vertical sectional view of the means for forming the stream of fibrous material and for advancing the stream along the mandrel;

FIG. 4*b* illustrates the means for draping the filler into a web of cigarette paper and for subdividing the draped filler into rod-shaped sections of predetermined length;

FIG. 5 is a sectional view as seen in the direction of arrows from the line V—V of FIG. 4*a;*

FIG. 6 is a fragmentary sectional view as seen in the direction of arrows from the line VI—VI of FIG. 4*a;*

FIG. 7 is an enlarged fragmentary sectional view as seen in the direction of arrows from the line VII—VII of FIG. 4*a;*

FIG. 7*a* is a sectional view of a modification of a part of the structure which is shown in FIG. 7;

FIG. 8 is an enlarged fragmentary sectional view as seen in the direction of arrows from the line VIII—VIII of FIG. 4*a;* and FIG. 9 is an enlarged fragmentary sectional view as seen in the direction of arrows from the line IX—IX of FIG. 4*a.*

DESCRIPTION OF THE PREFERRED EMBODIMENTS

Figure 1:
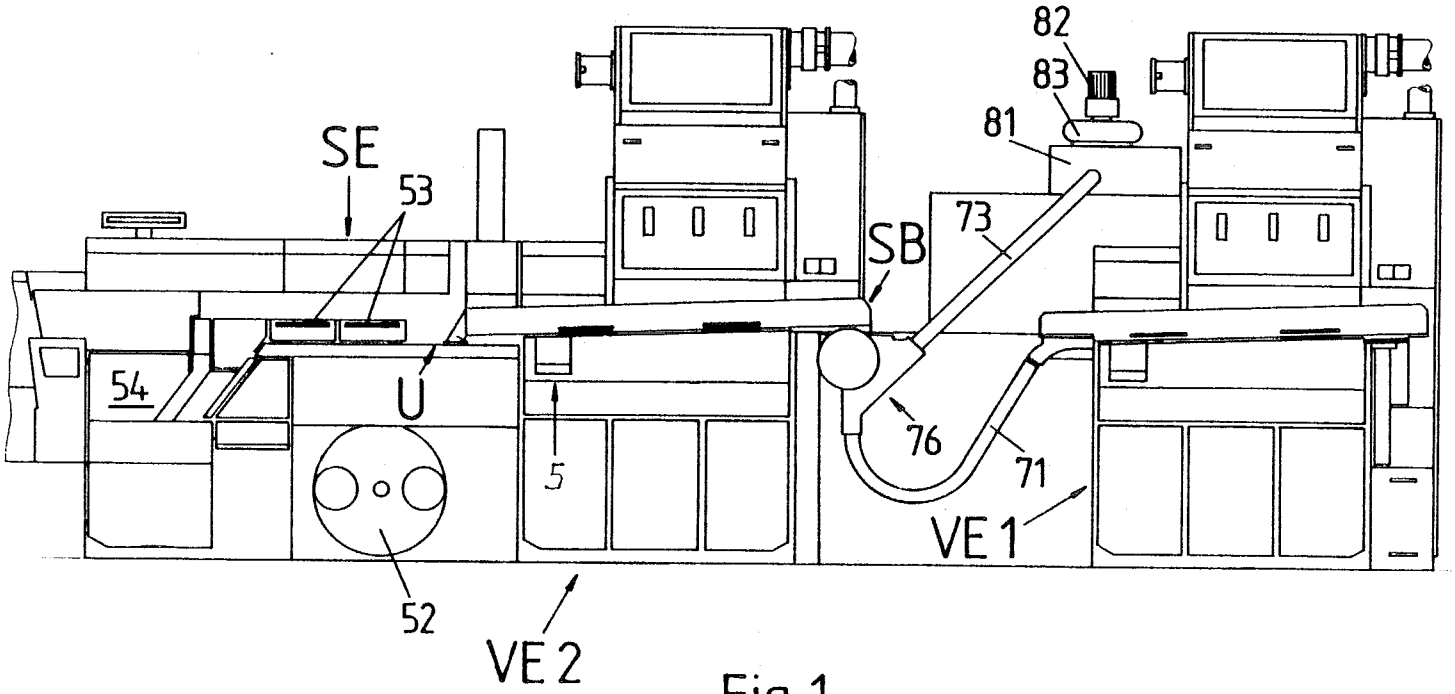
FIG. 1 is a schematic elevational view of an apparatus which embodies one form of the invention.

FIG. 1 shows schematically an apparatus for the making of plain cigarettes with soft cores. This term is intended to embrace cigarettes with axially extending holes. The apparatus comprises means for making a continuous filler consisting of tobacco and/or other fibrous material and for draping the filler into a continuous web 102 (FIG. 4*b*) of cigarette paper or other suitable wrapping material. The resulting continuous cigarette rod 107 (shown in FIG. 4*b*) is thereupon subdivided by a cutoff 54 to yield a file of plain cigarettes of predetermined (unit or multiple unit) length.

Figure 2:
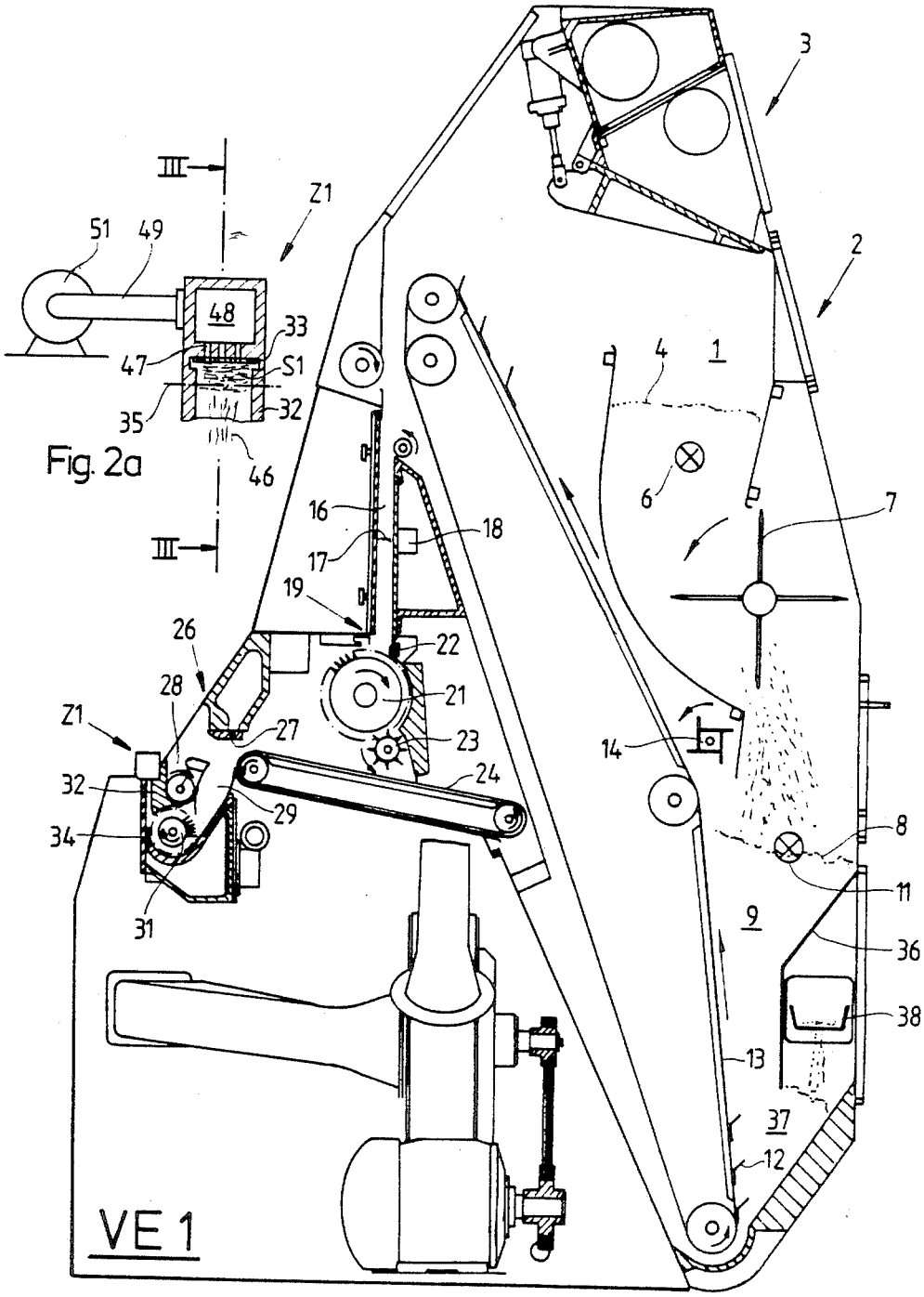
FIG. 2 is an enlarged partly elevational and partly vertical sectional view of the source of fibrous material and of the means for forming a narrow flow of fibrous material.
Figures 4A, 4B, 5, 6, 7, 7A, 8, 9:
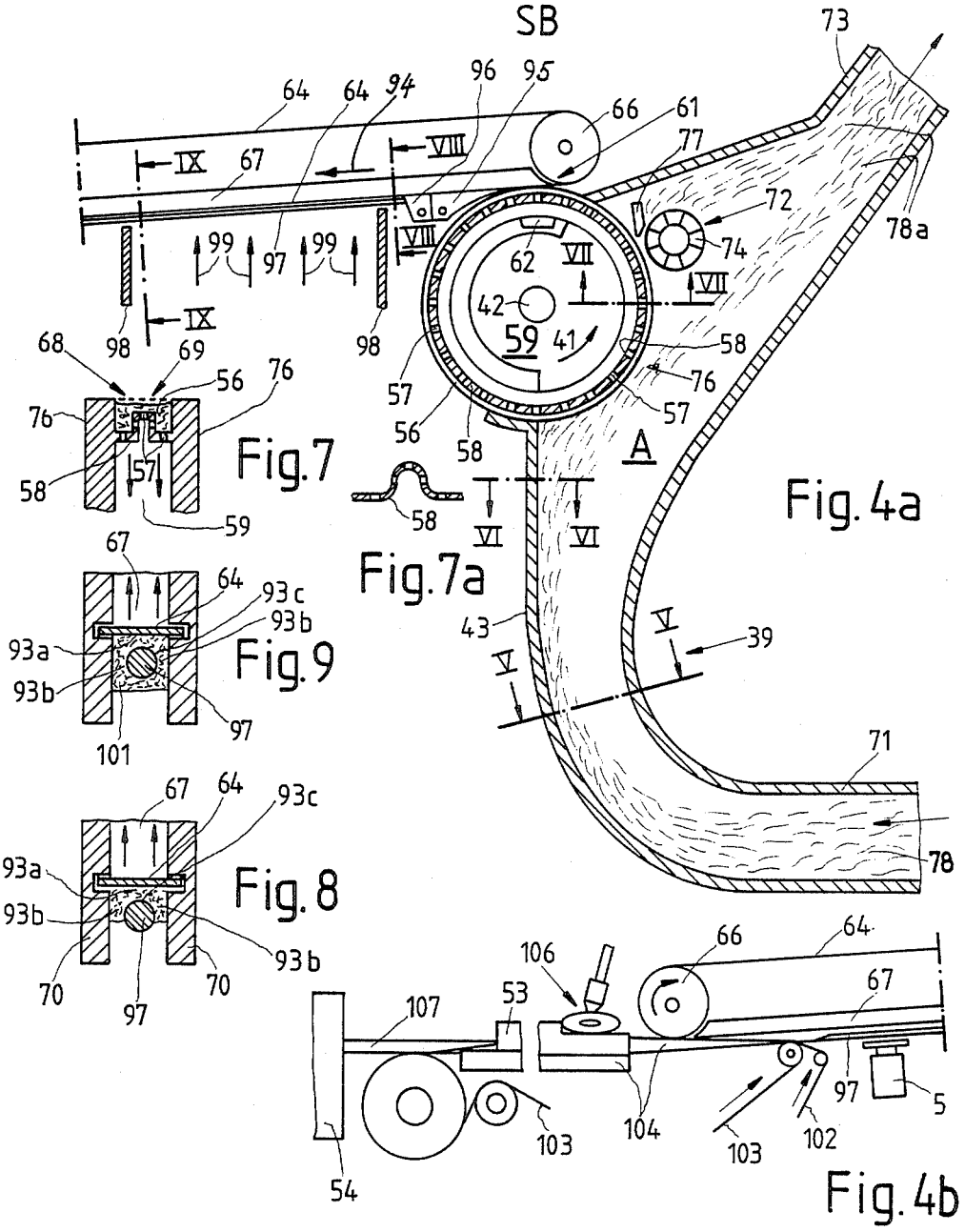

The reference character VE1 denotes in FIGS. 1 and 2 a metering unit or device which serves to supply a continuous flow S1 (FIGS. 2*a* and 3) of fibrous material (e.g., fragments of tobacco leaves), and such flow is delivered to a station A (shown in FIG. 4*a*) where it is converted into a continuous stream having a substantially U-shaped or trough-shaped cross-sectional outline with a centrally located longitudinally extending cavity **93*c* flanked by two longitudinally extending legs 93*b* which are connected to each other by a central portion or web 93*a* (see FIG. 8). The means for delivering the flow S1 to the station A (namely into the circumferential stream-forming groove 56 of an endless conveyor in the form of a suction wheel 76) comprises a pneumatic conveyor 71 which is operated with suction and delivers fibrous material with a surplus so that the groove 56 normally accepts only a portion of the flow S1. As can be seen in FIG. 7, the configuration of the groove 56 is such that it includes a relatively shallow central portion flanked by two deeper marginal portions so that the open side of the cavity 93*c* of the stream which is formed in the groove 56 faces toward the axis of the wheel 76. A further pneumatic conveyor 73 (which can constitute an extension of the conveyor 71) serves to return the non-accepted portion of the flow Sl to the source of fibrous material, namely to a magazine 9 in the distributor or hopper 2 shown in FIG. 2. The conduit of the pneumatic conveyor 73 contains a cyclone separator 81 which segregates the fibrous material of the non-accepted portion of the flow S1 from the gaseous carrier medium (normally air) and conveys the segregated fibrous material into the magazine 9. The cyclone separator 81 comprises an arcuate guide surface (not shown) along which the gaseous carrier medium is separated from the fibrous material. The thus separated fibrous material leaves the cyclone separator 81 by way of a cell wheel or any other suitable gate which discharges batches of fibrous material into the magazine 9. FIG. 1 merely shows the motor 82 and the fan 83 of the cyclone separator 81. Such means for segregating gaseous carrier media from flowable solid materials are well known in the tobacco processing industry. The conduit of the pneumatic conveyor 73 is connected to the suction intake of the fan 83**.

The reference character SB denotes that portion of the improved apparatus where the stream which is formed in the groove 56 of the wheel 76 is moved into contact with and along a stationary mandrel 97 of non-smokable material. The mandrel 97 is elongated and is disposed below the substantially horizontal lower reach or stretch of an endless foraminous belt conveyor 64 serving to advance the stream along the mandrel 97 while the stream is attracted to its lower reach by suction. The transfer of successive increments of the stream from the groove 56 of the wheel 76 to the underside of the lower reach of the conveyor 64 takes place in such a way that the cavity 93*c* of the stream faces downwardly and can receive the stationary mandrel 97. This can be readily seen in FIG. 8. In other words, the legs 93*b* of the stream which is transferred from the wheel 76 onto the conveyor 64 extend downwardly from the respective marginal portions of the web 93*a*.

The apparatus further comprises means (denoted by the character VE2) for feeding fibrous material against the exposed edge faces of the legs 93*b* and against the lower half of the external surface of the mandrel 97 while the stream advances with the lower reach of the conveyor 64 so that the stream is converted into a continuous filler 101 having a ring-shaped cross-sectional outline and surrounding the mandrel 97. The cross-sectional outline of the fully grown filler 101 can be seen in FIG. 9. A trimming or equalizing device 5 is provided to remove the surplus from the filler 101 prior to draping of the filler into the web 102.

When the filler 101 advances beyond the mandrel 97, its core (actually a hole in the center of the filler) is less dense than the tubular portion around the center. The core remains less dense than the tubular outer portion in spite of some compacting or condensing in the course of the wrapping operation so that each rod-shaped article (such as a plain cigarette of unit length or double unit length) includes a relatively soft core and a denser and harder tubular portion surrounding the core.

The rod forming unit SE of the apparatus which is shown in FIG. 1 comprises a draping or wrapping mechanism U wherein the web 102 is draped around the filler 101 downstream of the mandrel 97. The web 102 is drawn off a bobbin 52 and one of its marginal portions is coated with a film of adhesive paste (note the paster 106 in FIG. 4*b*) before such one marginal portion is caused to overlie the other marginal portion to form therewith a customary seam which extends in parallelism with the axis of the cigarette rod 107. The seam is dried during travel past a sealer 53 (e.g., a customary tandem sealer), and the finished cigarette rod 107 is thereupon severed by the knife or knives of the cutoff 54. The means VE2, the equalizing device 5 and the rod forming unit SE are similar to corresponding units of the cigarette making machine known as PROTOS (manufactured by the assignee of the present application).

Fibrous material which is fed by the means VE2 and is stored in the magazine 9 of the distributor 2 can consist of fragments of tobacco leaves, shreds of reconstituted tobacco, shreds or filaments of artificial tobacco (such as cellulose) or fibrous filter material of the type used for the making of filter mouthpieces for filter cigarettes, cigars or cigarillos.

The details of the metering unit VE1 are shown in FIGS. 2 and 2*a*. This unit is similar to the unit known as VE 80 which is used in the PROTOS machine. As shown in FIG. 2, the unit VE1 comprises a first magazine 1 which forms part of a distributor 2 and receives batches of tobacco particles or other fibrous material from an intermittently operated gate 3 at the discharge end of a pneumatic conveyor. The arrangement is such that the gate 3 opens to admit a batch of fibrous material when the level of the supply 4 of such material in the magazine 1 drops below the level of a photoelectric detector 6.

The magazine 1 supplies fibrous material to the aforementioned magazine 9 by way of an intermittently or continuously driven rotary rake 7 so that the upper level of the supply 8 of fibrous material in the magazine 9 is substantially constant. Such level is monitored by a photoelectric detector 11 which can be used to transmit signals serving to start, arrest, accelerate or decelerate the motor for the rake 7. The magazine 9 stores fibrous material which is delivered to the station of FIG. 2*a* where a continuous body of fibrous material is converted into the relatively narrow flow S1. The making of a satisfactory flow S1 is simplified and is more predictable if the magazine 9 contains a relatively small but constant supply 8 of fibrous material. This is ensured by the aforementioned detector 11 and rake 7. The means for withdrawing fibrous material from the supply 8 comprises an endless elevator conveyor 13 with equidistant pockets 12 which entrain discrete and preferably relatively small batches of fibrous material and dump the batches into an upright duct 16. Any surplus of fibrous material which is carried by the pockets 12 is brushed away by an equalizing or trimming device 14 in the form of a continuously driven paddle wheel adjacent the ascending reach of the elevator conveyor 13. The upper level of the supply 17 of fibrous material in the duct 16 is monitored by one or more photoelectric detectors 18 which control the motor for one or more pulleys of the elevator conveyor 13 so that the upper level of the supply 17 fluctuates very little or not at all.

The discharge end 19 of the duct 16 is adjacent the path of movement of the carding at the periphery of a rotary drum-shaped conveyor 21 which cooperates with a reciprocable substantially horizontal smoothing device 22 of the type disclosed in commonly owned U.S. Pats. Nos. 3,996,943 and 3,996,944 to Hinzmann and in commonly owned U.S. Pat. No. 4,011,966 to Wahle. The device 22 has a projection which extends into the discharge end 19 of the duct 16 to prevent bridging of fibrous material and to thus ensure that the carding of the conveyor 21 is uniformly filled with fibrous material which descends in the duct 16 toward and onto the conveyor 21. A rapidly driven picker roller 23 expels fibrous material from the carding of the conveyor 21 and converts the expelled material into a wide carpet on the upper reach of a wide belt conveyor 24 which is driven at a constant speed and propels the leader of the carpet against a curtain consisting of currents of compressed air issuing from a series of orifices 27 provided in the bottom wall of a plenum chamber forming part of a classifying device 26. Heavier particles of fibrous material (for example, fragments of tobacco ribs) penetrate across the curtain and are accumulated in an intercepting receptacle 28. The currents of compressed air which form the curtain of the classifying device 26 alter the trajectories of all lighter particles (particularly shreds of tobacco leaf laminae) and deflect such particles into a funnel 29 which causes the lighter particles to advance into the range of a showering device in the form of a rapidly rotating carded drum 31. The drum 31 converts the accumulated lighter particles of fibrous material into a narrow shower 46 (see FIG. 2*a*) whose constituents rise in a flow building channel 32 to impinge upon the underside of the lower reach of an endless foraminous belt conveyor 33 (see also FIG. 3). A plenum chamber below the drum 31 has a series of inclined orifices 34 which discharge streams of compressed air in a direction such that the particles forming the shower 46 have a component of movement in the direction of travel of the lower reach of the conveyor 33. The material of the shower advances substantially transversely of the direction of travel of the flow S1 with the conveyor 33. FIG. 2*a* shows that the conveyor 33 is a narrow belt whose lower reach travels below the perforated bottom wall 47 of a suction chamber 48 which has an outlet 49 connected with the suction intake of a fan 51. The suction chamber 48 and the fan 51 constitute a means for pneumatically attracting fibrous material of the shower 46 to the underside of the lower reach of the belt conveyor 33 so that the latter converts the shower 46 into the flow S1.

The flow S1 is equalized by a conventional trimming device 35 (FIG. 3) which can be of the type disclosed in commonly owned U.S. Pat. No. 4,564,028 to Heitmann. The surplus 88 which is removed by the trimming device 35 descends onto a belt conveyor 38 which returns the surplus into a magazine 37 of the distributor 2. The magazine 37 is partially separated from the magazine 9 by a partition 36 and is adjacent to the path of movement of the pockets 12 so that each batch of fibrous material which is dumped into the duct 16 comprises a smaller portion containing fibrous material which is withdrawn from the magazine 37 and a larger portion containing fibrous material which is drawn from the supply 8 in the magazine 9. The illustrated belt conveyor 38 can be replaced by or used jointly with one or more vibratory conveyors or any other suitable means for returning the removed surplus 88 from the trimming device 35 to the source including the magazines 9 and 37.

Figure 3:
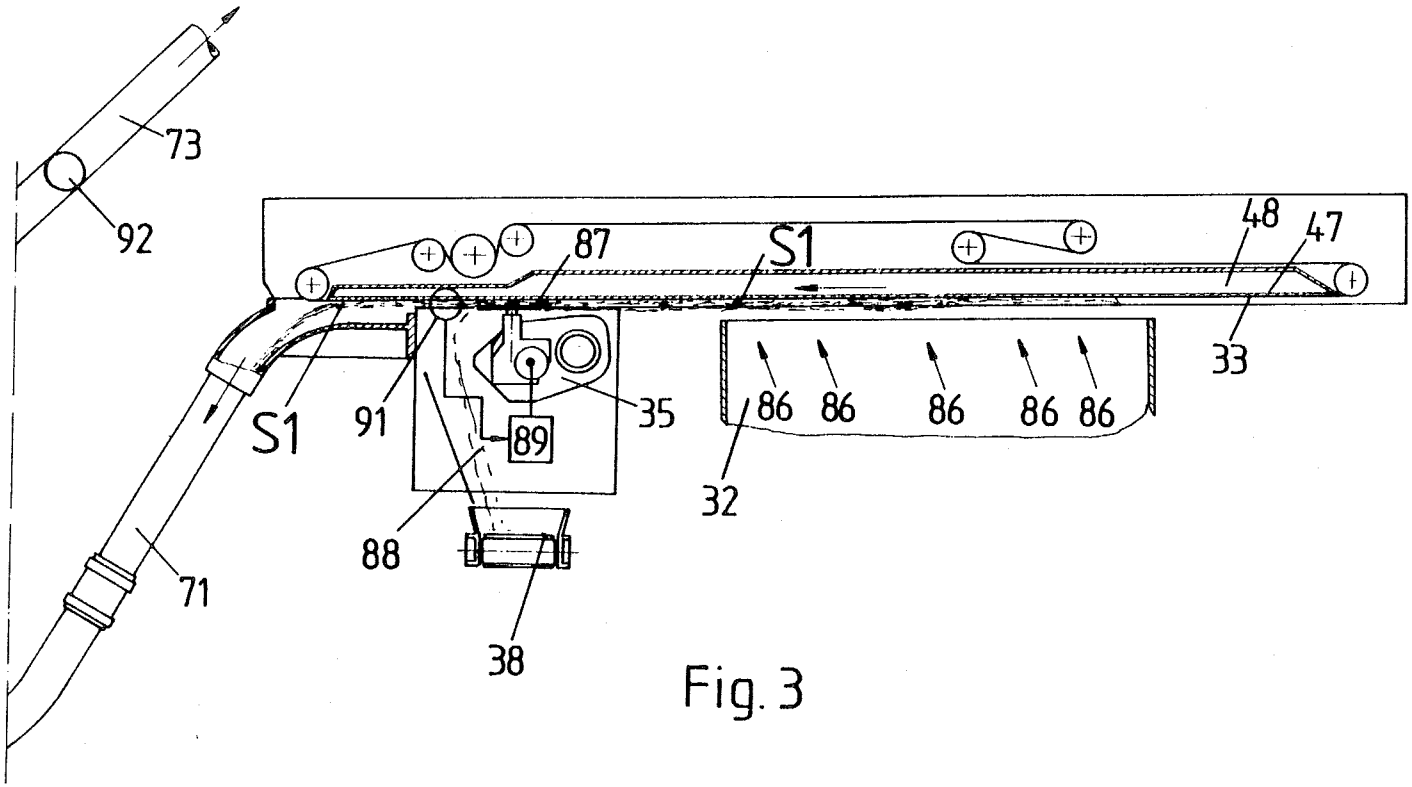
FIG. 3 is a longitudinal vertical sectional view as seen in the direction of arrows from the line III—III of FIG. 2*a;*

FIG. 3 shows that the lower reach of the conveyor 33 travels above the discharge end of the channel 32 which delivers fibrous material in directions indicated by arrows 86, i.e., with a component of movement in the direction of travel of the lower reach of the conveyor 33. The discharge end of the conveyor 33 admits successive increments of the flow S1 into the inlet of the conduit of the pneumatic conveyor 71 which delivers the flow to the circumferentially extending groove 56 of the wheel 76 (see particularly FIG. 4*a*). FIGS. 3 and 4*a* further show a portion of the pneumatic conveyor 73 which delivers the surplus **78*a* of the flow S1 (i.e., that fibrous material which is not accepted by the groove 56) and the gaseous carrier medium to the cyclone separator 81**.

The trimming device 35 of FIG. 3 preferably comprises two coplanar material clamping discs 87 which rotate at a level above a rotary brush, knife or any other suitable surplus removing tool (not shown) so that fibrous material which extends downwardly below the plane of the discs 87 is brushed or cut away and forms the surplus 88 which descends onto the conveyor 38 for transport into the magazine 37 of the distributor 2. The reference character 89 denotes an adjusting device which serves to change the level of the clamping discs 87 of the trimming device 35 so as to select the quantity of surplus material which is caused to descend onto the conveyor 38. The adjusting device 89 can comprise a reversible motor which receives signals from a density monitoring device 91 immediately downstream of the trimming device 35 and/or from a monitoring device 92 in or adjacent the pneumatic conveyor 73. Thus, the level of the trimming device 35 can be regulated as a function of the density of the trimmed flow S1 and/or as a function of the quantity of surplus **78*a* in the conduit of the pneumatic conveyor 73. The just described mode of adjusting the trimming device 35 is known and is disclosed in numerous United States patents and patent applications of the assignee of the present application. The monitoring device 91 and/or 92 can comprise a source of corpuscular radiation (e.g., a source of beta rays) and a transducer including an ionization chamber. Such monitoring devices (known as NSR) are distributed by the assignee of the present application and are designed to monitor the mass per unit length of a flow of fibrous material. Signals which are generated by the device 91 and/or 91 are compared with reference signals denoting the desired quantity of fibrous material per unit length of the flow S1 and/or flow 78*a*, and the adjusting device 89 is caused to raise or lower the trimming device 35 when the signals denoting the mass of fibrous material in the trimmed flow S1 and/or in the conduit of the pneumatic conveyor 73** deviate from the reference signals.

The equalized flow S1 is automatically separated from the conveyor 33 by gravity at the left-hand end of the suction chamber 48 (as seen in FIG. 3).

FIG. 4a shows that the discharge end of the conduit of the pneumatic conveyor 71 constitutes an elbow 39 which has a circular cross-sectional outline at the level of the line V—V (see FIG. 5) and thereupon gradually changes its cross-sectional outline to that which is shown in FIG. 6 so that it forms a narrow channel 44 which serves to aim successive increments of the fibrous material therein into successive increments of the groove 56 at the periphery of the wheel 76. The latter is mounted for rotation about the axis of a horizontal shaft 42 and is driven in a counterclockwise direction (arrow 41). The bottom wall 43 for the channel 44 extends substantially radially of the wheel 76 and very close to the periphery of the wheel at the station A where successive increments of the trimmed flow S1 are converted into successive increments of the aforementioned stream including the legs **93*b* and web 93*a* and defining the cavity 93*c*. The width of the channel 44 at the station A equals or approximates the width of the groove 56**. As can be seen in FIG. 4*a*, the uppermost portion of the wall 43 has an extension-which is adjacent to the periphery of the wheel 56 so as to provide a seal against the escape of air from the conveyor 71.

The groove 56 surrounds an annular peripheral wall 58 which is formed with suction ports 57 (see also FIG. 7) in communication with a stationary suction chamber 59 in the interior of the wheel 76. The suction chamber 59 is effective along an arc of nearly 180 degrees so as to ensure that fibrous material which is supplied by the channel 44 of the conveyor 71 is attracted into the groove 56 of the continuously driven wheel 76 whereby the groove accumulates a continuous stream of fibrous material. A narrow plenum chamber 62 is adjacent a transfer station 61 where the stream leaves the groove 56 to be attracted to the underside of the lower reach of a foraminous endless belt conveyor 64. The plenum chamber 62 is maintained at atmospheric pressure or discharges air at a slightly elevated pressure so that the jets of air which penetrate through the adjacent ports 57 assist in the transfer of the stream from the wheel 76 onto the conveyor 64.

The conveyor 64 forms part of the aforementioned portion SB wherein the stream is moved into contact with the stationary mandrel 97. The lower reach of the conveyor 64 travels between the sidewalls 70 of an elongated narrow channel (see particularly FIG. 8) at a level below a suction chamber 67 which attracts fibrous material to the conveyor 64 while successive increments of the transferred stream advance along and beyond the mandrel 97.

The apparatus further comprises a trimming or equalizing device 72 which removes the surplus from the stream in the groove 56 of the wheel 76 ahead of the transfer station 61. The trimming device 72 comprises a stationary knife 77 and a rotor 74 which carries a set of orbiting knives cooperating with the cutting edge of the knife 77 not unlike the blades of shears. The cutting edges of orbiting knives on the rotor 74 are preferably inclined with reference to the axis of the rotor to further enhance the shearing action and to ensure that the trimmed stream which reaches the transfer station 61 exhibits a U-shaped profile (FIG. 8), i.e., the trimming device 72 does not adversely affect the cross-sectional outline of the stream which is formed in the groove 56. The aforediscussed inclination of cutting edges of the knives on the rotor 74 further ensures that the particles which form the surplus 78*a* in the conveyor 73 are automatically propelled in the axial direction of the rotor 74 and do not tend to travel toward the transfer station 61. Reference may be had to the aforementioned copending patent application Ser. No. 836,527 which describes a similar trimming device. The trimming device 72 preferably further comprises means (not specifically shown) for adjusting the position of the axis of the rotor 74 relative to the stationary knife 77 to thereby select the quantity of fibrous material per unit length of the trimmed stream which is being transferred onto the conveyor 64.

The cross-sectional outline of the groove 56 in the peripheral surface of the wheel 76 is shown in FIG. 7. The configuration of the outer side of the wall 58 of the wheel 76 is such that the depth of the central portion 69 of the groove 56 is less than the depth of the two marginal portions 68 which flank the central portion 69. This ensures the formation of a stream with the aforediscussed legs 93*b*, web 93*a* and cavity 93*c*.

FIG. 7*a* shows the wall 58 of a somewhat modified wheel which ensures that the transition between the shallower central portion of the groove in the periphery of such wheel and the marginal portions of the groove is more gradual than in the embodiment of FIG. 7.

Fibrous material 78 (trimmed flow SI) which is supplied by the channel 44 of the end portion 39 of the conduit of the pneumatic conveyor 71 advances radially toward the axis of the wheel 76 and enters successive increments of the groove 56 to be converted into an arcuate stream having a radially inwardly facing cavity 93*c* flanked by the legs 93*b*. The exposed side of the stream in the groove 56 is substantially convex because the stream carries a surplus which extends radially beyond the groove 56 and is removed by the trimming device 72. The surplus 78*a* is drawn into the conduit of the conveyor 73 and is transported into the cyclone separator 81 and thence back into the metering unit VE1.

The trimmed side of the stream is attracted to the underside of the lower reach of the conveyor 64 downstream of the transfer station 61, and the legs 93*b* of such stream extend downwardly so that the cavity 93*c* between the legs 93*b* is accessible from below. The direction in which the lower reach of the conveyor 64 advances is indicated by the arrow 94. The mandrel 97 is mounted on a stationary carrier or support 96 which is installed in the frame of the apparatus below the transfer station 61. The mandrel 97 extends into the cavity 93*c* and across the open upper end of a duct 98 which serves to deliver additional fibrous material in directions indicated by arrows 99.

The duct 98 forms part of the feeding means VE2 and delivers a shower of ascending fibrous material which conceals the lower half of the peripheral surface of the mandrel 97 and is converted into a second U-shaped stream whose legs extend upwardly and are integrated into the legs 93*b* of the stream which is suspended at the underside of the lower reach of the conveyor 64. The manner in which the feeding means VE2 can form a homogeneous and uniform shower of fibrous material is or can be the same as the manner of forming the shower 46 in the unit VE1 of FIGS. 2 and 2*a*.

The thus obtained filler 101 is separated from the mandrel 97 by the conveyor 64 and is equalized by the trimming device 5 to be thereupon draped into the web 102 during travel with the upper reach of an endless belt conveyor 103 forming part of a conventional wrapping mechanism 104 at the downstream end of the path which is defined by the lower reach of the conveyor 64. The latter is trained over pulleys 66 and is driven in sychronism with the wheel 76 and conveyor 103.

The mandrel 97 is preferably provided with a smooth external surface to reduce friction with the fibrous material of the filler 101. This can be achieved by appropriate treatment of the external surface of the mandrel 97 and/or by coating the external surface with one or more layers of friction reducing material.

The carrier 96 for the mandrel 97 is oscillated by a vibrator 95, preferably at a frequency in the supersonic range because such oscillatory movements bring about a pronounced reduction of friction between the mandrel 97 and the filler 101.

If desired, the mandrel 97 can constitute a nozzle having a longitudinally extending channel and radially outwardly extending orifices (not specifically shown) which discharge into the material of the filler 101 a stream of gaseous fluid (e.g., air) to reduce friction between the filler and the stream on the one hand and the mandrel on the other hand. Such arrangement can be resorted to in addition to or in lieu of the vibrator 95. The gaseous fluid which is discharged by the orifices of the mandrel 97 can be used as a carrier medium for one or more flavoring agents and/or as a medium for supplying moisture to or for removing moisture from the material of the filler. Furthermore, the gaseous fluid can influence the temperature of the filler 101. Reference may be had to the commonly owned copending patent application Ser. No. 660,430 which fully discloses several types of means for conditioning fibrous material by a gaseous fluid which is discharged by the orifices of a mandrel. An advantage of a hollow mandrel which can admit one or more flavoring agents is that even highly volatile flavoring agents are unlikely to escape from the filler 101 because they are introduced immediately or closely upstream of the wrapping mechanism 104.

The filler 101 and the web 102 are converted into the aforementioned cigarette rod 107 which is subdivided into plain cigarettes of unit length or multiple unit length, and the plain cigarettes are delivered to a packing machine, to storage or into a filter tipping machine, such as the machine known as MAX or MAX S.

The wrapping mechanism 104 reduces the diameter of the filler 101 during conversion into the wrapped portion of the rod 107. Nevertheless, the density of the wrapped filler is still more pronounced adjacent the inner side of the wrapper and is less pronounced in the region of the axis of the rod 107.

The improved method and apparatus can be used for the making of all kinds of rod-shaped articles of the tobacco processing industry including plain cigarettes, cigars, cigarillos or cheroots as well as filter rod sections which are used for the making of mouthpieces for filter cigarettes, cigars and like products. The fibrous material may consist of or can contain natural tobacco, reconstituted tobacco and/or artificial tobacco (including cellulose and many others).

The mandrel 97 can be configurated and mounted in such a way that it extends into the cavity of the stream before the stream leaves the groove 56 of the wheel 76 or another suitable conveyor. For example, the right-hand end of the mandrel 97 which is shown in FIG. 4*a* can extend along an arc of approximately 180 degrees all the way to the top of the wall 43. The apparatus which is shown in FIG. 4*a* (i.e., wherein the mandrel is received in the cavity 93*c* of a fully formed and trimmed stream) is preferred at this time due to its simplicity and ready separability of the mandrel from the frame without affecting the wheel 76.

The trimming or equalizing devices 5, 35 and 72 constitute optional but desirable and advantageous elements of the improved apparatus. For example, the apparatus can be operated without the trimming device 35 or 72.

The metering unit VE1 exhibits the important advantage that the groove 56 of the wheel 76 receives accurately metered quantities of fibrous material so as to ensure the formation of a highly satisfactory stream having a substantially U-shaped cross-sectional outline. Conversion of batches (in the pockets 12) of fibrous material into a carpet (on the conveyor 24), thereupon into a shower 46 and ultimately into a flow S1 which is trimmed and pneumatically conveyed to the station A has been found to ensure the formation of a satisfactory stream even if the supply 8 in the magazine 9 contains only fragments of tobacco leaves. One or more of the just described steps which are performed in the unit VE1 can be omitted or modified without departing from the spirit of the invention.

The described and illustrated trimming device 5, 35 and/or 72 can be replaced with other types of trimming devices. The utilization of a trimming device (35) which operates in such a way that it determines the height of the flow S1 has been found to be particularly advantageous for the formation of a satisfactory stream in the groove 56 of the wheel 76 or another suitable endless conveyor.

The making of a stream having a substantially U-shaped cross-sectional outline preparatory to the making of the filler 101 exhibits the advantage that the stream can be trimmed and/or otherwise treated prior to the making of the filler above the open upper end of the duct 98. Moreover, the making of a stream ahead of the station for the mandrel 97 reduces the likelihood of forming an unsatisfactory stream because the making of the stream is not influenced by the mandrel.

An additional advantage of the improved apparatus is that it can employ numerous conventional components which have been tested in machines for the making of conventional plain cigarettes and analogous rod-shaped articles of the tobacco processing industry. These components can include the trimming devices, the elevator (13) and other belt-like conveyors, the means for holding fibrous material by suction, the wrapping mechanism, the paster, the sealer, the cutoff, the cyclone separator and the monitoring devices.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing rod-shaped articles of the tobacco processing industry from fibrous material, particularly tobacco, with a mandrel of non-smokable material, comprising the steps of forming a continuous fibrous stream having a substantially U-shaped cross-sectional outline with a longitudinally extending cavity and two legs flanking the cavity; advancing the stream along the mandrel so that the mandrel at least partially fills the cavity; showering fibrous material against the moving stream so as to confine the cavity and the mandrel and thereby transform the stream into a filler having a ring-shaped cross-sectional outline; separating the filler from the mandrel; draping the separated filler into a web of wrapping material; and subdividing the draped filler into rod-shaped articles of predetermined length.

2. The method of claim 1, wherein said forming step comprises admitting fibrous material into the groove of a first driven endless conveyor so that the cavity of the resulting stream is confined, and thereupon transferring the stream onto a second driven endless conveyor on which the cavity is exposed so that it can receive the mandrel.

3. The method of claim 1, further comprising the step of equalizing the filler prior to said draping step.

4. The method of claim 3, wherein said equalizing step precedes said separating step.

5. The method of claim 1, further comprising the step of vibrating the mandrel.

6. The method of claim 5, wherein said vibrating step includes imparting to the mandrel oscillatory movements at a frequency in the ultrasonic range.

7. The method of claim 1, further comprising the step of admitting a gaseous fluid medium between the mandrel and the surrounding fibrous material so as to reduce friction between the mandrel on the one hand and the stream and the filler on the other hand.

8. The method of claim 1, further comprising the step of conditioning the fibrous material around the mandrel.

9. The method of claim 8, wherein said conditioning step includes utilizing a nozzle-like mandrel and admitting a fluid conditioning medium into the fibrous material of the stream and/or into the fibrous material of the filler by way of the mandrel.

10. The method of claim 1, wherein said stream forming step comprises establishing and maintaining a supply of fibrous material, drawing from the supply a continuous flow of fibrous material and pneumatically conveying the flow, and converting at least a portion of the pneumatically conveyed flow into said stream.

11. The method of claim 10, wherein said drawing step includes showering fibrous material in a first direction into a flow building zone and conveying the showered material in the flow building zone in a second direction transversely of the first direction.

12. The method of claim 11, wherein said last named showering step includes propelling fibrous material against one side of a driven endless belt conveyor and attracting the fibrous material to the belt conveyor by suction.

13. The method of claim 10, further comprising the step of equalizing the flow.

14. The method of claim 10, wherein said converting step includes utilizing a portion of the pneumatically conveyed flow for the making of the stream, and further comprising the step of returning the remaining portion of the flow to the supply.

15. The method of claim 14, wherein said step of pneumatically conveying includes transporting the fibrous material in a gaseous carrier medium and said returning step includes separating the gaseous carrier medium from said remaining portion of the flow.

16. Apparatus for producing rod-shaped articles of the tobacco processing industry from fibrous material, particularly tobacco, comprising an elongated mandrel; means for forming a continuous fibrous stream having a substantially U-shaped cross-sectional outline with a longitudinally extending cavity and two legs flanking the cavity; means for advancing the stream along the mandrel so that the mandrel at least partially fills the cavity; means for showering fibrous material against the moving stream so as to confine the cavity and the mandrel and thereby transform the stream into a filler having a ring-shaped cross-sectional outline; and means for draping the filler into a web of wrapping material.

17. The apparatus of claim 16, further comprising means for separating the filler from the mandrel and means for subdividing the draped filler into rod-shaped sections of predetermined length.

18. The apparatus of claim 17, wherein said separating means comprises said advancing means.

19. The apparatus of claim 16, wherein said forming means comprises a driven endless conveyor.

20. The apparatus of claim 19, wherein said endless conveyor comprises a rotary wheel having a circumferential stream-forming groove including a central portion having a first depth, and two marginal portions flanking said central portion and having a greater second depth.

21. The apparatus of claim 19, further comprising means for attracting fibrous material to said endless conveyor by suction.

22. The apparatus of claim 19, further comprising means for equalizing the stream on said endless conveyor.

23. The apparatus of claim 16, further comprising means for equalizing the filler prior to draping.

24. The apparatus of claim 16, further comprising means for vibrating the mandrel.

25. The apparatus of claim 24, wherein said vibrating means comprises means for oscillating the mandrel at a frequency within the ultrasonic range.

26. The apparatus of claim 16, wherein said mandrel has at least one orifice and further comprising a source of compressed gaseous fluid connected with said mandrel and communicating with said orifice so that the mandrel discharges gaseous fluid into the adjacent fibrous material.

27. The apparatus of claim 26, wherein said source contains compressed air which reduces friction between the external surface of the mandrel on the one hand and the fibrous material on the other hand.

28. The apparatus of claim 26, wherein said source contains a conditioning fluid for fibrous material.

29. The apparatus of claim 16, wherein said forming means comprises a source of fibrous material, a first driven endless conveyor, means for delivering fibrous material from said source to said first conveyor to form thereon a narrow flow of fibrous material, and a second driven endless conveyor arranged to transform the flow into said stream.

30. The apparatus of claim 29, wherein said first conveyor is foraminous and further comprising means for attracting fibrous material to said foraminous conyeyor by suction.

31. The apparatus of claim 29, further comprising means for equalizing the flow ahead of said second conveyor.

32. The apparatus of claim 31, wherein said equalizing means comprises means for removing fibrous material from the flow and further comprising means for adjusting said equalizing means so as to regulate the quantity of removed fibrous material.

33. The apparatus of claim 29, further comprising means for transferring successive increments of the flow from said first conveyor to said second conveyor by suction.

34. The apparatus of claim 29, further comprising means for conveying the flow from said first conveyor to said second conveyor in a gaseous carrier medium, said second conveyor being arranged to accept a portion of the flow and further comprising means for returning the remaining portion of the flow to said source.

35. The apparatus of claim 34, wherein said returning means comprises a conduit and further comprising cyclone separator means provided in said conduit to segregate the non-accepted portion of the flow from the carrier medium.

36. A method of prodcing rod-shaped articles of the tobacco processing industry from fibrous material, particularly tobacco, with a mandrel of non-smokable material, comprising the steps of forming a continuous fibrous stream having a substantially U-shaped cross-sectional outline with a longitudinally extending cavity and two legs flanking the cavity, including admitting fibrous material into the groove of a first driven endless conveyor so that the cavity of the resulting stream is confined, and thereupon transferring the stream onto a second driven endless conveyor on which the cavity is exposed so that it can receive the mandrel; advancing the stream along the mandrel so that the mandrel at least partially fills the cavity; feeding fibrous material against the moving stream so as to confine the cavity and the mandrel and thereby transform the stream into a filler having a ring-shaped cross-sectional outline; separating the filler from the mandrel; draping the separated filler into a web of wrapping material; and subdividing the draped filler into rod-shaped articles of predetermined length.

37. The method of claim 36, wherein the first conveyor includes a wheel having a circumferentially extending groove with a central portion of lesser depth and two marginal portions of greater depth flanking the central portion.

38. The method of claim 36, further comprising the step of holding the fibrous material on at least one of the conveyors by suction.

39. The method of claim 36, further comprising the step of equalizing the stream on the first conveyor.

40. Apparatus for producing rod-shaped articles of the tobacco processing industry from fibrous material, particularly tobacco, comprising an elongated mandrel; means for forming a continuous fibrous stream having a substantially U-shaped cross-sectional outline with a longitudinally extending cavity and two legs flanking the cavity, said forming means comprising a driven endless conveyor and said conveyor comprising a rotary wheel having a circumferential stream-forming groove including a central portion having a first depth and two marginal portions flanking said central portion and having a greater second depth; means for advancing the stream along the mandrel so that the mandrel at least partially fills the cavity; means for feeding fibrous material against the moving stream so as to confine the cavity and the mandrel and thereby transform the stream into a filler having a ring-shaped cross-sectional outline; and means for draping the filler into a web of wrapping material.

41. The apparatus of claim 40, wherein said advancing means comprises a second driven endless conveyor arranged to receive the stream from the groove of said wheels so that the cavity of the stream is exposed and can receive the mandrel.

42. The apparatus of claim 41, further comprising means for attracting the stream to said second conveyor by suction.

43. Apparatus for producing rod-shaped articles of the tobacco processing industry from fibrous material, particularly tobacco, comprising an elongated mandrel; means for forming a continuous fibrous stream having a substantialy U-shaped cross-sectional outline with a longitudinally extending cavity and two legs flanking the cavity, said forming means comprising a source of fibrous material, a first driven endless conveyor, means for delivering fibrous material from said source to said first conveyor to form thereon a narrow flow of fibrous material, and a second driven endless conveyor arranged to transform the flow into said stream; means for advancing the stream along the mandrel so that the mandrel at least partially fills the cavity; means for feeding fibrous material against the moving stream so as to confine the cavity and the mandrel and thereby transform the stream into a filler having a ring-shaped cross-sectional outline; and means for draping the filler into a web of wrapping material.

44. The apparatus of claim 43, wherein said forming means further comprises a pneumatic conveyor arranged to transport the flow from said first conveyor to said second conveyor.

45. The apparatus of claim 43, wherein said delivering means comprises means for showering fibrous material onto said first conveyor.

* * * * *